US008485392B1

(12) United States Patent
Tarter

(10) Patent No.: US 8,485,392 B1
(45) Date of Patent: Jul. 16, 2013

(54) SYSTEM FOR DISPENSING SOLVENTS

(76) Inventor: Jeffrey Wilson Tarter, Saratoga, CA (US)

( * ) Notice: Subject to any disclaimer, the term of this patent is extended or adjusted under 35 U.S.C. 154(b) by 1297 days.

(21) Appl. No.: 12/287,468

(22) Filed: Oct. 8, 2008

(51) Int. Cl.
*B67D 7/56* (2010.01)

(52) U.S. Cl.
USPC ..... 222/23; 222/1; 222/25; 222/39; 222/52; 222/108; 222/129; 222/130; 222/132; 222/173; 222/192; 222/481.5; 137/312

(58) Field of Classification Search
USPC ..... 222/1, 23, 25, 39, 52, 108, 129, 130, 222/132, 173, 192, 481.5; 137/312, 314
See application file for complete search history.

(56) References Cited

U.S. PATENT DOCUMENTS 4,098,431 A * 7/1978 Palmer et al. ..... 222/39
4,691,850 A * 9/1987 Kirschmann et al. ..... 222/642
4,947,888 A * 8/1990 Tanner ..... 137/312
4,957,222 A * 9/1990 Rolfe ..... 222/148
5,133,880 A * 7/1992 Lundquist et al. ..... 210/774
5,202,667 A * 4/1993 Alvin ..... 340/605
5,314,027 A * 5/1994 Wood ..... 169/60
5,388,761 A * 2/1995 Langeman ..... 239/1
5,577,817 A * 11/1996 Reynolds ..... 312/107
5,583,790 A * 12/1996 Lan et al. ..... 700/282
5,697,527 A * 12/1997 Altieri et al. ..... 222/132
5,779,799 A * 7/1998 Davis ..... 118/663
5,890,520 A * 4/1999 Johnson, Jr. ..... 141/94
6,061,605 A * 5/2000 Davis ..... 700/121
6,689,621 B2 * 2/2004 Merten et al. ..... 436/180
6,715,692 B2 * 4/2004 Peterson et al. ..... 239/8
6,931,305 B2 * 8/2005 Sherwood ..... 700/282
7,096,895 B2 * 8/2006 Barker ..... 141/94
7,575,015 B2 * 8/2009 Reid et al. ..... 137/15.11
7,721,751 B1 * 5/2010 Perrien ..... 137/234.6

* cited by examiner

*Primary Examiner* — Frederick C Nicolas
(74) *Attorney, Agent, or Firm* — Haverstock & Owens LLP

(57) ABSTRACT

A system for dispensing solvents removes the need for storing solvents in multitudes of small containers or containers which are not suitable for storing the solvents for a long duration. The system minimizes laboratory space requirements for the storage and handling of solvents. The system minimizes waste generation. With the system for dispensing solvents, the solvents are stored properly and are able to be dispensed in small quantities for use as needed. The system for dispensing solvents also includes leak detection, a spill tray, a fume hood and other precautionary measures to ensure a safe handling environment.

24 Claims, 5 Drawing Sheets

SYSTEM FOR DISPENSING SOLVENTS

FIELD OF THE INVENTION

The present invention relates to the field of dispensing solvents. More specifically, the present invention relates to the field of dispensing flammable, toxic and other hazardous solvents more safely and accurately while utilizing less space in laboratories and manufacturing facilities.

BACKGROUND OF THE INVENTION

Solvent distribution in most labs remains a holdover from the 1950's where solvents are carried in, in four-liter glass containers and then manually poured into flasks, beakers and other laboratory glassware for their intended use. Waste solvents are similarly collected in small containers at the bench and then carried out of the lab where they are lab-packed or consolidated for hazardous waste disposal. Unfortunately, current large scale laboratory practices can no longer tolerate this archaic, inefficient method of solvent handling. Solvent use in today's labs is increasing significantly and competing for ever more critical lab space. Furthermore, when solvent is stored in bottles for long periods of time, much of it is wasted or expires before it is able to be used. On top of the cost of the wasted solvent, there is also the additional cost associated with proper disposal of the solvent.

SUMMARY OF THE INVENTION

An accurate, safe system for automatically dispensing solvents eliminates the need for handling and storing solvents in numerous containers spread throughout the lab. With the system for dispensing solvents, the solvents are stored properly in twenty-liter or larger bulk containers and are able to be dispensed in precise quantities for use as needed thereby reducing waste generated. The system for dispensing solvents also includes numerous safety controls and interlocks such as leak detection, spill containment, local fume capture and exhaust and other precautionary measures to ensure safe handling of these hazardous materials.

In one aspect, a system for dispensing hazardous solvents comprises a body, one or more solvent dispensers coupled to the body, the one or more solvent dispensers for dispensing the solvents and a control system operably coupled to the one or more solvent dispensers, the control system for controlling the one or more solvent dispensers. The system further comprises a fume hood for removing fumes. The system further comprises a spill tray for containing solvent spills. The system further comprises a waste drain for draining solvent. The body is bench top mounted. The system further comprises a leak detection component. The system further comprises a lower explosive limit detector. The system further comprises an audible alarm for alerting a user when a fault occurs. The control system includes a touch screen, keypad or other input device. The system further comprises an emergency shut off mechanism.

In another aspect, a system for storing and dispensing solvents comprises a dispensing system for dispensing the solvents, the dispensing system including a control system for controlling the dispensing of the solvents, a delivery system coupled to the dispensing system, the delivery system for storing the solvents and delivering the solvents to the dispensing system. The solvents are stored remotely. The system further comprises a remote controller coupled to the dispensing system for remote monitoring and controlling. The solvents are at least one of flammable and hazardous. The dispensing system further comprises a fume hood for removing fumes. The dispensing system further comprises a waste drain for draining solvent. At least one of the dispensing system and the delivery system further comprises a leak detection component. The dispensing system further comprises a lower explosive limit detector. At least one of the dispensing system and the delivery system further comprises an audible alarm for alerting a user when a fault occurs. The system further comprises an emergency shut off mechanism.

In yet another aspect, a system for dispensing hazardous solvents comprises a body, a fume hood coupled to the body, the fume hood for removing fumes, a spill tray coupled to the body, the spill tray for containing solvent spills, one or more solvent dispensers coupled to the body, the one or more solvent dispensers for dispensing the solvents and a control system operatively coupled to the one or more solvent dispensers, the control system for controlling the solvent dispensers. The system further comprises a delivery system coupled to the one or more solvent dispensers, the delivery system for storing the solvents and delivering the solvents to the one or more solvent dispensers.

In another aspect, a method of storing and dispensing hazardous solvents comprises storing one or more solvents in one or more containers and dispensing a solvent of the one or more solvents utilizing a control system operatively coupled to one or more solvent dispensers. A fume hood removes fumes of the one or more solvents as the one or more solvents are dispensed. The one or more containers are within a delivery system coupled to the one or more solvent dispensers, the delivery system delivers the solvents to the one or more solvent dispensers.

DETAILED DESCRIPTION OF THE PREFERRED EMBODIMENT

A dispensing system enables users to dispense solvents safely without requiring a large amount of space. The dispensing system complies with proper good laboratory practices and other industry standards, as well as federal, state and local codes and regulations. The dispensing system is able to be coupled to solvent supply containers ranging from 20 liters to 1250 liters, or more, for bulk distribution, or laboratory containers containing 20 liters or less. Using the dispensing system solvents, a user is able to dispense high purity solvents for experimental use or for use in High Pressure Liquid Chromatographs (HPLC's) and similar analytical equipment.

The dispensing system incorporates an integral fume exhaust system, eliminating the need or expense of a separate fume hood, while saving valuable lab bench space. The dispensing system also provides safe supply and storage of dangerous materials. The dispensing system is able to be combined with a solvent waste drain and collection system to handle waste in a safe and efficient manner. While minimizing the dispensing system footprint is an important feature, safety is paramount to the design and operation of the system.

Figure 1:
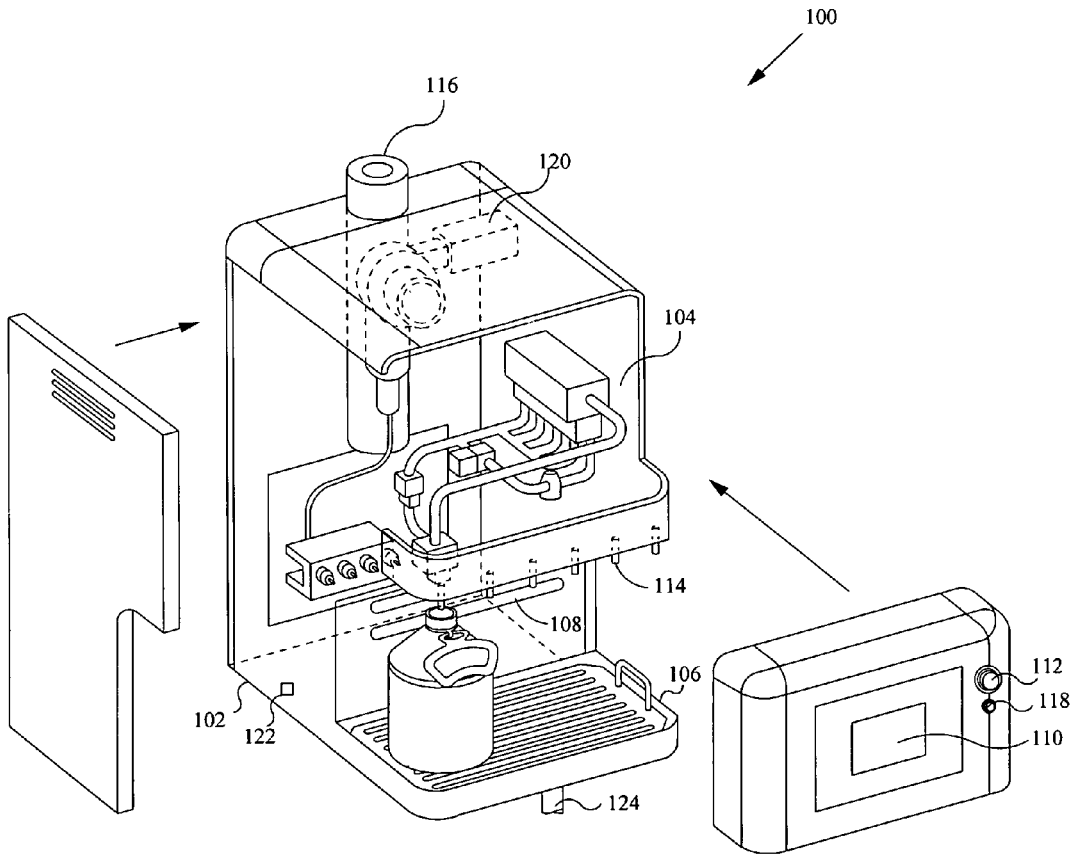
FIG. 1 illustrates a perspective view of internal components of a dispensing system in accordance with the present invention.

FIG. 1 illustrates a perspective view of internal components of a dispensing system 100 in accordance with the present invention. The dispensing system 100 includes a casing or body 102. The dispensing system 100 further includes operating components 104 such as tubing and electronic components for supplying solvents, removing fumes, purging vapors, monitoring the dispensing system 100, controlling the dispensing system 100 and performing related operations. In some embodiments, the body 102 is sized to sit atop a workbench or table. In some embodiments, the body 102 is approximately 2 feet wide×3 feet deep×3 feet tall. In some embodiments, the body 102 is slightly larger or smaller. In some embodiments, the body is remotely coupled to the dispense mechanism. In some embodiments, the body 102 comprises stainless steel. In some embodiments, the body 102 comprises another material such as a solvent-resistant polymer. In some embodiments, the plumbing and liquid delivery components of the operating components 104 is Teflon®, Kynar®, stainless steel or another appropriate material. In some embodiments, the plumbing is equipped with redundant actuated valves and visual position indicators. The body 102 includes an exhaust duct 116 with a connecting collar on the top of the body 102. A vapor sensor 120 detects vapor quantities to determine if there is a dangerous amount. The exhaust ventilation airflow is interlocked. In some embodiments, solvent couplings are inside the body 102, and lines passing through the body are sealed with a grommet or Swagelok® bulkhead connector. A gas sensor for a Lower Explosive Limit (LEL) alarm is positioned within/coupled to the body 102. A front panel of the body 102 opens for access to the operating components 104. In some embodiments, the body is equipped with flow sensors to monitor the dispensing specified volumes or dispense accurate mixtures.

A spill tray 106 prevents spilled solvents from dispersing out onto the bench top. In some embodiments, a Lexan® splashguard is used. In some embodiments, the spill tray 106 includes a leak detector. In some embodiments, the spill tray 106 is able to be coupled to a drain.

A fume hood 108 is included within/coupled to the body to capture any fumes from the solvents. A leak detector 122 is able detect leaks, and in some embodiments, trigger an alarm 118.

A control panel 110 provides easy user operation of the dispensing system 100. In some embodiments, the control panel 110 is coupled to the front of the body 102. In some embodiments, the control panel 110 implements a touch screen. In some embodiments, flow status is displayed on the control panel 110. The control panel 110 includes a reset button. In some embodiments, reservoir level status is indicated on the control panel 110. In some embodiments, indicator lights are displayed next to each valve to indicate level status of each reservoir on the control panel 110. The lights display status including: normal, warning, fault, alarm and/or other status. In some embodiments, an audible alarm indicates a fault condition (e.g. ventilation or leak) on the control panel 110 and/or a remote alarm module. The control panel 110 also includes an alarm-reset button. The control panel 110 controls one or more dispensers 114. Using the touch screen, keypad or other input device of the control panel 110, solvents are able to be dispensed. In some embodiments, the one or more dispensers 114 are controlled by a device or mechanism instead of or in addition to the control panel 110. In some embodiments, there are up to six or more modular dispensers 114. Appropriate airflow inlets are located in the dispensing area (area below the dispensers 114). In some embodiments, the dispensing area accommodates up to a standard 4-liter jug. In some embodiments, solvent mixtures are able to be dispensed.

An emergency stop mechanism 112 such as a switch or button allows a user to immediately shut down the dispensing system 100 in case of an emergency, for example, a leak. The emergency stop button 112 shuts off/disables delivery of the solvents. An alarm 118 alerts a user if there is a dangerous condition present.

Figure 2:
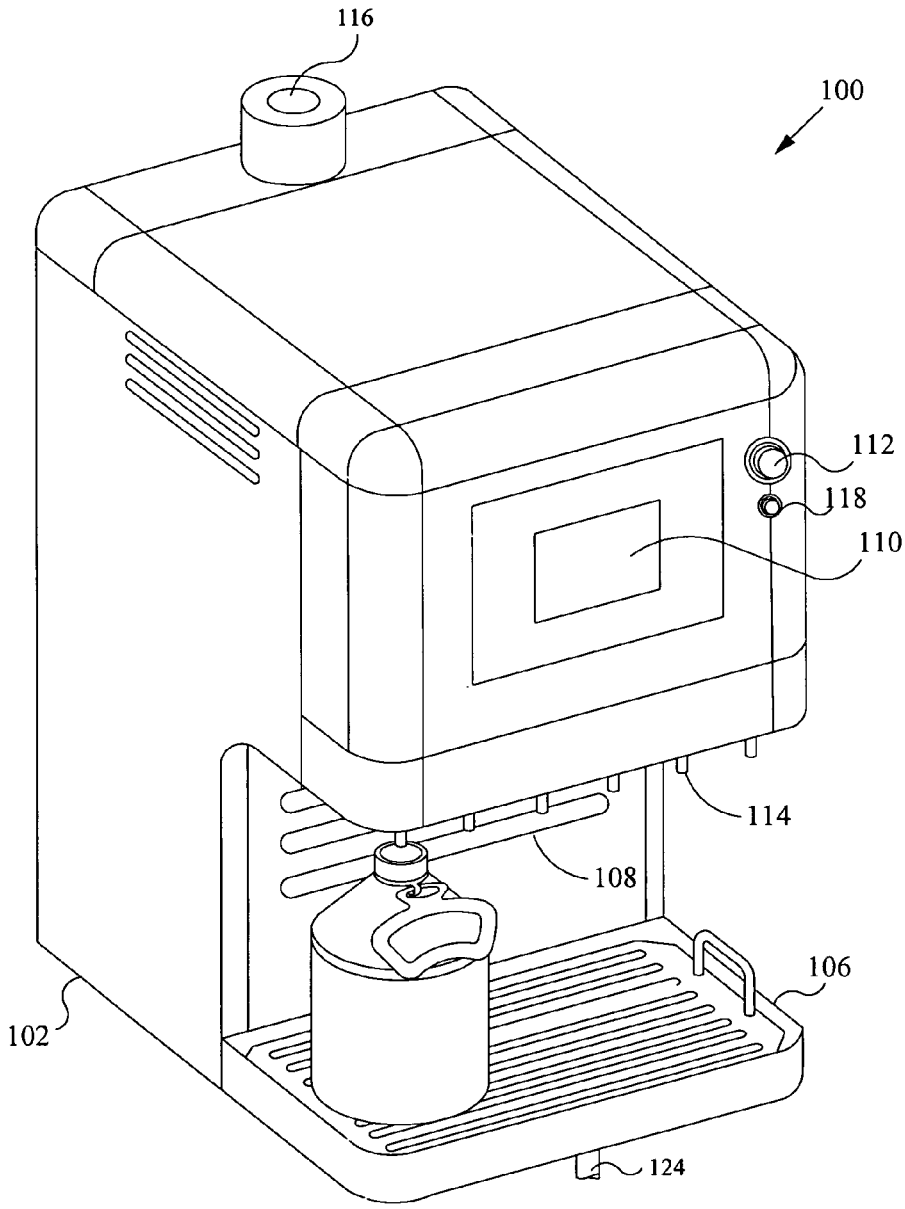
FIG. 2 illustrates a perspective view of a dispensing system in accordance with the present invention.

FIG. 2 illustrates a perspective view of a dispensing system 100 in accordance with the present invention. The dispensing system 100 includes a body 102, which contains operating components 104 (FIG. 1), a spill tray 106, a fume hood 108, a control panel 110 and an emergency stop mechanism 112, amongst other components. As described above, the dispensing system 100 has a small form factor, thus does not take up much valuable laboratory space. The dispensing system 100 is able to dispense solvents to proper containers as well as monitor the remotely stored solvents while the solvents are waiting to be dispensed.

Figure 3:
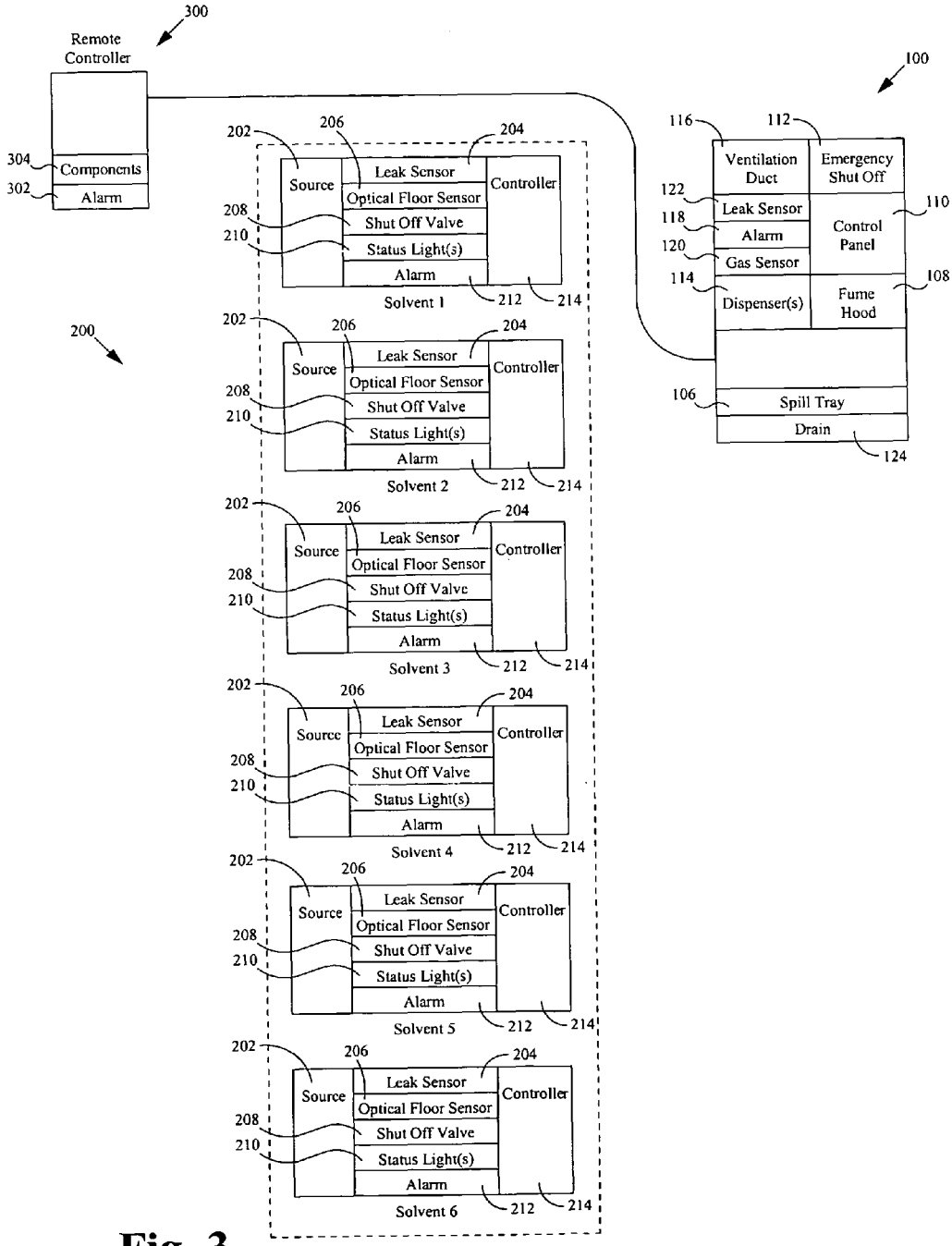
FIG. 3 illustrates a block diagram of a dispensing system, a chemical delivery system and a remote controller in accordance with the present invention.

FIG. 3 illustrates a block diagram of a dispensing system 100, a chemical delivery system 200 and a remote controller 300 in accordance with the present invention. The chemical delivery system 200 includes sources 202 of the chemicals dispensed by the dispensing system 100. Each source 202 has additional components for monitoring and controlling the source 202. A leak sensor 204 detects any leak of the source 202. An optical flow sensor 206 monitors the flow of the solvent from the source 202. A shut off valve 208 used to control flow from the source 202 if necessary. Status light(s) 210 show the status of the container such as system normal, leak or other statuses. An audible alarm 212 is included to alert a user of any fault/error in the system. A controller 214 enables the source 202 to communicate with the remote controller 300 and the dispensing system 100. For example, signals to begin dispensing a solvent are communicated from the dispensing system 100 to the controller 214, which controls the valve components to release the solvent to the dispensing system 100. Furthermore, each of the leak sensor 204, optical flow sensor 206, pneumatic shut off valve 208, remote status light(s) 210 and alarm 212 is able to be controlled and/or monitored by the dispensing system 100. The chemical delivery system 200 is able to be located in another room than the dispensing system 100.

The chemical delivery system 200 is coupled to the dispensing system 100. For clarity, the tubing or other mechanism that couples the chemical delivery system 200, specifically, the sources 202 to the dispensing system 100 is not shown. The dispensing system 100 includes a spill tray 106, a fume hood 108, a control panel 110, an emergency shut off 112, and one or more dispensers 114. As described above, the spill tray 106 ensures that any spilled solvents do not disperse beyond a limited range. In some embodiments, beneath the spill tray is a drain 124 for draining any spilled solvents. The fume hood 108 removes any fumes from the air before causing any potential hazard. The control panel 110 provides a user with the ability to monitor the dispensing system 100 as well as the chemical delivery system 200. The control panel 110 also enables a user to control the dispensing system 100 such as pushing a touch screen button to dispense a solvent. The emergency shut off 112 enables a user to quickly shut down the dispensing system 100 in case of an error or hazardous condition such as a spill outside the containment. The one or more dispensers 114 are used to dispense the solvent into a container that the user has placed beneath the desired dispenser 114. An exhaust duct 116 provides proper ventilation for the dispensing system 100. In addition to the control panel 110 providing status information and the ability to monitor the dispensing system 100, an alarm 118 is able to alert a user of a serious problem. A vapor sensor 120 is a way of detecting a lower explosive limit, which would set off the alarm 118. Other sensors are able to be used as well such as a leak detector 122. The dispensing system 100 also provides inert gas pressure to flow the solvent from a source to the dispensing system 100.

The remote controller 300 is coupled to the dispensing system 100 for remote monitoring of the dispensing system 100 and the chemical delivery system 200. The remote controller 300 also includes an alarm 302 for a remote alarm. In some embodiments, the remote controller 300 includes additional components 304.

Figure 4:
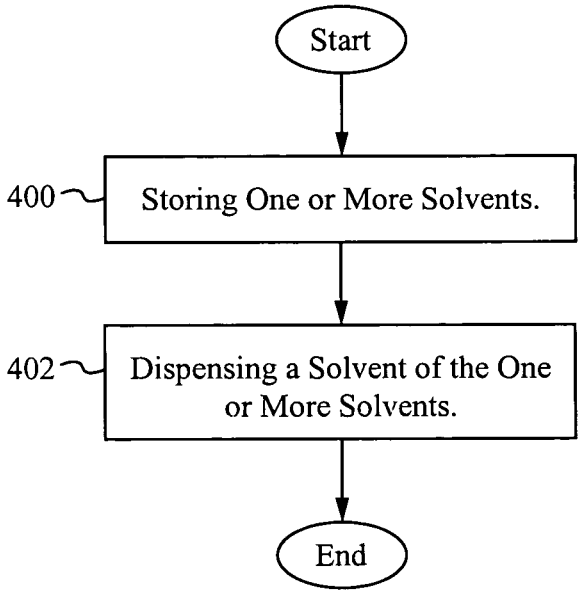
FIG. 4 illustrates a flow chart of a method of storing and dispensing solvents using a dispensing system in accordance with the present invention.

FIG. 4 illustrates a flow chart of a method of storing and dispensing solvents using a dispensing system in accordance with the present invention. In the step 400, solvents are stored in appropriate storage containers coupled to the chemical delivery system 200 and coupled to the dispensing system 100. In some embodiments, after the solvents are stored, the solvents are monitored to ensure there are no leaks or other issues with the stored solvents. As described above, the solvents are able to be monitored by sensors, such as gas sensors and/or leak sensors. The solvents are able to be monitored utilizing other mechanisms as well. Monitoring is able to occur at the chemical delivery system, the dispensing system or via a remote controller. In the step 402, a solvent of the solvents is dispensed into a container that a user is utilizing for temporary storage of the solvent. In some embodiments, a user is able to select the quantity of solvent dispensed (e.g. 100 milliliters, or other fixed quantity) or the user is able to manually press and hold a button until the desired amount of solvent has been dispensed.

Figure 5:
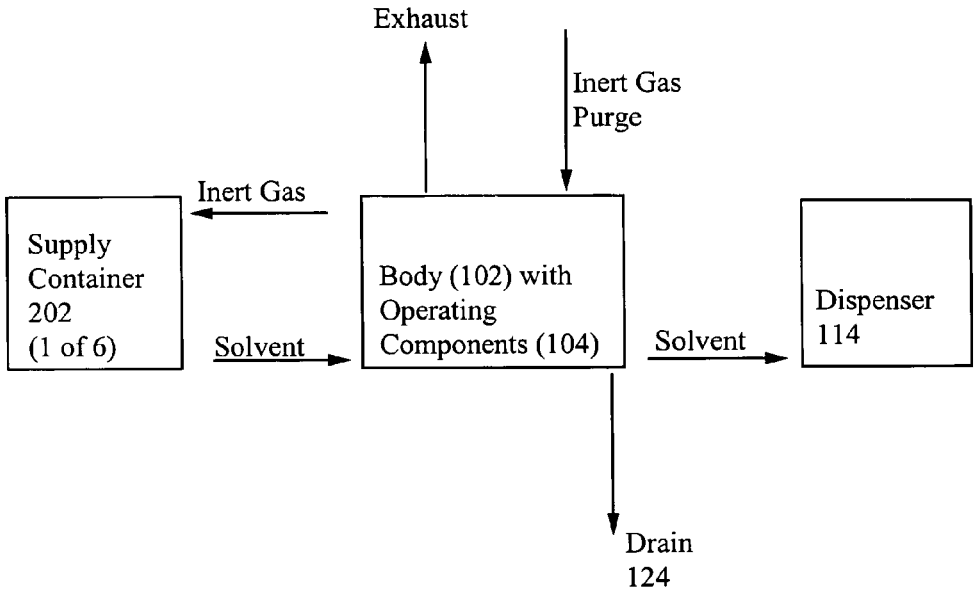
FIG. 5 illustrates a diagram view of the dispensing system and delivery system in operation.

FIG. 5 illustrates a diagram view of the dispensing system 100 and delivery system 200 in operation. Specifically, an inert gas is transferred from the operating components 102 contained within the body 102 to the supply container/source 202 of the delivery system to cause the solvent stored in the source 202 to be transferred to the operating components 104. In some embodiments, other methods of transferring the solvent are implemented. Any toxic fumes are expelled by the exhaust, and any spilled solvent goes to the drain 124. The solvent is properly dispensed via a dispenser 114 which receives the solvent from the operating components 104.

To utilize the dispensing system, a user places a container such as a beaker below a desired solvent dispenser to receive a solvent. The user then utilizes the control panel with a touch screen, key pad or other input device to select the solvent dispenser to dispense the solvent. Once, the desired amount of solvent is dispensed, the user is able to remove the container and utilize the solvent as desired. To monitor the dispensing system including the chemical delivery system, the user has several options, the main one being through the control panel. With a remote controller, the user also is able to monitor the dispensing system. Both, the control panel and remote controller are operatively coupled to sensors/detectors and other components within the dispensing system, which provide information related to the system to the user.

In operation, the dispensing system stores solvents when not in use. However, the solvents are easily dispensed by a push of a screen or button on a control panel. For safety reasons, a spill tray and splashguard are implemented. Furthermore, a fume hood ensures any toxic or flammable fumes or vapors are properly captured and exhausted. Additional leak detection and safeguards are also implemented for safety purposes. The control panel is able to be used to inspect and monitor aspects of the dispensing system to ensure they are functioning properly. By storing the solvents properly in storage tanks and only releasing the desired solvents needed for use, waste is significantly minimized and safety is improved.

The present invention has been described in terms of specific embodiments incorporating details to facilitate the understanding of principles of construction and operation of the invention. Such reference herein to specific embodiments and details thereof is not intended to limit the scope of the claims appended hereto. It will be readily apparent to one skilled in the art that other various modifications may be made in the embodiment chosen for illustration without departing from the spirit and scope of the invention as defined by the appended claims.

What is claimed is:

1. A system for dispensing hazardous solvents comprising:

a. a housing;

b. one or more solvent dispensers coupled to the housing, the one or more solvent dispensers for dispensing the solvents;

c. a control system integrated within the housing and operably coupled to the one or more solvent dispensers, the control system for controlling the one or more solvent dispensers; and d. a vapor sensor for measuring vapor quantities and determining of a level of vapor quantities equal or exceed a threshold indicating a dangerous level.

2. The system of claim 1 further comprising a fume hood for removing fumes, wherein the fume hood is integrated into the housing.

3. The system of claim 1 further comprising a spill tray for containing solvent spills.

4. The system of claim 1 further comprising a waste drain for draining solvent.

5. The system of claim 1 wherein the housing is bench top mounted.

6. The system of claim 1 further comprising a leak detection component.

7. The system of claim 1 further comprising a lower explosive limit detector.

8. The system of claim 1 further comprising an audible alarm for alerting a user when a fault occurs.

9. The system of claim 1 wherein the control system includes an input device selected from the group consisting of a touch screen and a keypad.

10. The system of claim 1 further comprising an emergency shut off mechanism.

11. A system for storing and dispensing solvents comprising:

a. a dispensing system for dispensing the solvents, the dispensing system comprising:

i. a housing;

ii. a plurality of solvent dispensers coupled to the housing; and iii. a control system integrated into the housing for controlling the dispensing of the solvents, the control system including indicator lights near each of one or more valves of the dispensing system that indicate a status of a source of the solvent associated with the valve; and b. a delivery system coupled to the dispensing system, the delivery system for storing the solvents and delivering the solvents to the dispensing system.

12. The system of claim 11 wherein the solvents are stored remotely.

13. The system of claim 11 further comprising a remote controller coupled to the dispensing system for remote monitoring and controlling.

14. The system of claim 11 wherein the solvents are at least one of flammable and hazardous.

15. The system of claim 11 wherein the dispensing system further comprises a fume hood for removing fumes, wherein the fume hood is integrated within the housing.

16. The system of claim 11 wherein the dispensing system further comprises a waste drain for draining solvent.

17. The system of claim 11 wherein at least one of the dispensing system and the delivery system further comprises a leak detection component.

18. The system of claim 11 wherein the dispensing system further comprises a lower explosive limit detector.

19. The system of claim 11 wherein at least one of the dispensing system and the delivery system further comprises an audible alarm for alerting a user when a fault occurs.

20. The system of claim 11 further comprising an emergency shut off mechanism.

21. A system for dispensing hazardous solvents comprising:

a. a housing having an exterior channel for receiving containers to be filled with solvents;

b. a horizontal fume hood integrated into the housing, the fume hood for removing fumes;

c. a spill tray integrated into the housing, the spill tray for containing solvent spills;

d. a plurality of solvent dispensers coupled to the housing, the plurality of solvent dispensers for dispensing the solvents; and e. a control system operatively coupled to the plurality of solvent dispensers, the control system for controlling the solvent dispensers, the control system including a control panel integrated into the housing for displaying a flow status and a reservoir level;

wherein the exterior channel includes a top formed by the plurality of solvent dispensers coupled to the housing, a back formed by the horizontal fume hood integrated into the housing and a bottom formed by the spill tray integrated into the housing such that the plurality of solvent dispensers, the fume hood and the spill tray are all able to simultaneously access the containers when positioned within the exterior channel.

22. The system of claim 21 further comprising a delivery system coupled to the plurality of solvent dispensers, the delivery system for storing the solvents and delivering the solvents to the one or more solvent dispensers.

23. A method of storing and dispensing hazardous solvents comprising:

a. storing one or more solvents in one or more containers; and b. dispensing a solvent of the one or more solvents utilizing a control system operatively coupled to a plurality of solvent dispensers, the control system including indicator lights near each of one or more valves of a dispensing system that indicate a status of a source of the solvent associated with the valve;

wherein the control system and the plurality of solvent dispensers are integrated into a housing, wherein a fume hood removes fumes of the one or more solvents as the one or more solvents are dispensed, wherein the fume hood is integrated into the housing.

24. A method of storing and dispensing hazardous solvents comprising:

a. storing one or more solvents in one or more containers; and b. dispensing a solvent of the one or more solvents utilizing a control system operatively coupled to a plurality of solvent dispensers, the control system including indicator lights near each of one or more valves of a dispensing system that indicate a status of a source of the solvent associated with the valve;

wherein the control system and the plurality of solvent dispensers are integrated into a housing, wherein the one or more containers are within a delivery system coupled to the plurality of solvent dispensers, the delivery system delivers the solvents to the plurality of solvent dispensers.

* * * * *